US008591080B2

(12) United States Patent
Hsieh et al.

(10) Patent No.: US 8,591,080 B2
(45) Date of Patent: Nov. 26, 2013

(54) LAMP

(75) Inventors: Yi-Chu Hsieh, New Taipei (TW); Hui-Feng Jen, New Taipei (TW); Che-Hsin Liao, New Taipei (TW); Jia-Yi Juang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/585,803

(22) Filed: Aug. 14, 2012

(65) Prior Publication Data

US 2013/0170237 A1 Jul. 4, 2013

Related U.S. Application Data

(60) Provisional application No. 61/582,399, filed on Jan. 1, 2012.

(30) Foreign Application Priority Data

Feb. 14, 2012 (TW) ..... 101104681 A

(51) Int. Cl.
*F21V 33/00* (2006.01)

(52) U.S. Cl.
USPC ..... 362/437; 362/353

(58) Field of Classification Search
USPC ..... 362/437, 438, 439, 443, 353, 355, 356
See application file for complete search history.

(56) References Cited

U.S. PATENT DOCUMENTS

| | | | | |
|---|---|---|---|---|
| 3,379,872 | A * | 4/1968 | Devine, Jr. | 362/443 |
| 4,998,193 | A * | 3/1991 | Chuing-Hui | 362/414 |
| 6,039,463 | A * | 3/2000 | Lin | 362/414 |

FOREIGN PATENT DOCUMENTS

| | | |
|---|---|---|
| TW | M332788 | 5/2008 |
| TW | I324236 | 5/2010 |
| TW | M391058 | 10/2010 |
| TW | 201104137 | 2/2011 |
| TW | M397481 | 2/2011 |
| TW | I343976 | 6/2011 |
| TW | 201122356 | 7/2011 |
| TW | M412304 | 9/2011 |
| TW | M414788 | 10/2011 |
| TW | M416019 | 11/2011 |
| TW | M422029 | 2/2012 |

* cited by examiner

*Primary Examiner* — Laura Tso
(74) *Attorney, Agent, or Firm* — Jianq Chyun IP Office

(57) ABSTRACT

A lamp including a case assembly, a lamp bottom and a fixing elastomer is provided. The case assembly has a first opening, and the lamp bottom inserts into the first opening to assemble with the case assembly. The lamp bottom has a first surface, a second opening and multiple first positioning structures. The second opening passes through the first surface, and the first positioning structures are located on the first surface. The fixing elastomer is disposed in the case assembly and has a second surface and a pair of second positioning structures suitable for locking with two of the first positioning structures.

11 Claims, 5 Drawing Sheets

LAMP

CROSS-REFERENCE TO RELATED APPLICATION

This application claims the priority benefits of U.S. provisional application Ser. No. 61/582,399, filed on Jan. 1, 2012 and Taiwan application serial no. 101104681, filed on Feb. 14, 2012. The entirety of each of the above-mentioned patent applications is hereby incorporated by reference herein and made a part of this specification.

BACKGROUND OF THE DISCLOSURE

1. Field of the Disclosure

The invention relates to a lamp, and more particularly to a lamp with a case assembly that can rotate relative to a lamp bottom.

2. Description of Related Art

Everyday, people use desk lights to supply more light to indoor areas with insufficient light. For example, when an area of a desk or an office desk does not have enough light, a desk light is used to brighten the workspace. A user can then use the desk or office desk for reading or other activities, and does not need to worry about eye deterioration because of insufficient light at the workspace.

A conventional desk light has a desk light bottom, a light casing, and a lamp bottom. Using the conventional method to assemble desk lights, after the desk light bottom and the light casing are assembled, the lamp bottom is then screwed into the desk light bottom by hand. However, after the lamp bottom is screwed into the desk light bottom, the angle of the light emitting surface of the desk light may not be the illuminating angle required by the user. Thus, the lamp bottom must be disassembled from the desk light bottom, and the starting position must be readjusted for reassembly. This method is very inconvenient for the user.

SUMMARY OF THE DISCLOSURE

The invention is directed to a lamp with a case assembly that can rotate relative to a lamp bottom, so as to conveniently adjust a light emitting surface to an illumination angle required by the user.

The invention provides a lamp, including a case assembly, a lamp bottom, and a fixing elastomer. The case assembly includes a first opening, and the lamp bottom inserts into the first opening to assemble with the case assembly. The lamp bottom includes a first surface, a second opening, and a plurality of first positioning structures. The second opening passes through the first surface, and the first positioning structures are located on the first surface. The fixing elastomer is disposed in the case assembly, and has a second surface and a pair of second positioning structures. The second positioning structures are disposed on the second surface, and lock with two of the first positioning structures.

In an embodiment of the invention, the first positioning structures are concaves, and the second positioning structures are protrusions.

In an embodiment of the invention, the fixing elastomer includes a circular body portion and a pair of locking portions. The locking portions are bent and extended from the opposite sides of the circular body portion. A displacement is between the locking portions and the circular body portion, and the second positioning structures are disposed on the circular body portion. In addition, the lamp further includes a pair of protrusions disposed in the case assembly. The protrusions are located on the opposite sides of the first opening, and the locking portions are disposed on and around the protrusions. In addition, the lamp further includes a pair of locking elements. The locking elements pass through the locking portions and fix to the case assembly.

In an embodiment of the invention, the lamp further includes a pair of locking elements passing through the fixing elastomer and fixed to the case assembly.

In an embodiment of the invention, the fixing elastomer further includes a pair of elastic arms located between the circular body portion and the locking portions. The second positioning structures are disposed on the elastic arms. In addition, the elastic arms are formed from hollowing out a connection area between the circular body portion and the locking portions.

In an embodiment of the invention, the lamp bottom includes a main body and a base. The main body includes a concave, and the base is detachably assembled to the concave of the main body. The base is suitable to be inserted into the first opening, wherein the first surface, the second opening, and the first positioning structures are disposed in the base.

In an embodiment of the invention, the case assembly includes a first casing and a second casing that is detachably assembled to the first casing. The first casing includes a first concave opening, and the second casing includes a second concave opening. The second concave opening and the first concave opening together form the first opening.

Based on the above, in the lamp of the invention, since the case assembly is disposed on and around the lamp bottom, the effect of rotation between the lamp bottom and the case assembly is achieved. When the lamp bottom is rotated into a lamp body of the lamp, the user can rotate the case assembly relative to the lamp bottom, and easily adjust the angle of the light emitting surface of the case assembly relative to the user. In addition, through the mutual locking between the first positioning structures and the second positioning structures, the angle between the case assembly and the lamp bottom can be fixed.

In order to make the aforementioned features and advantages of the invention more comprehensible, embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DETAILED DESCRIPTION OF THE EMBODIMENTS

Figure 1:
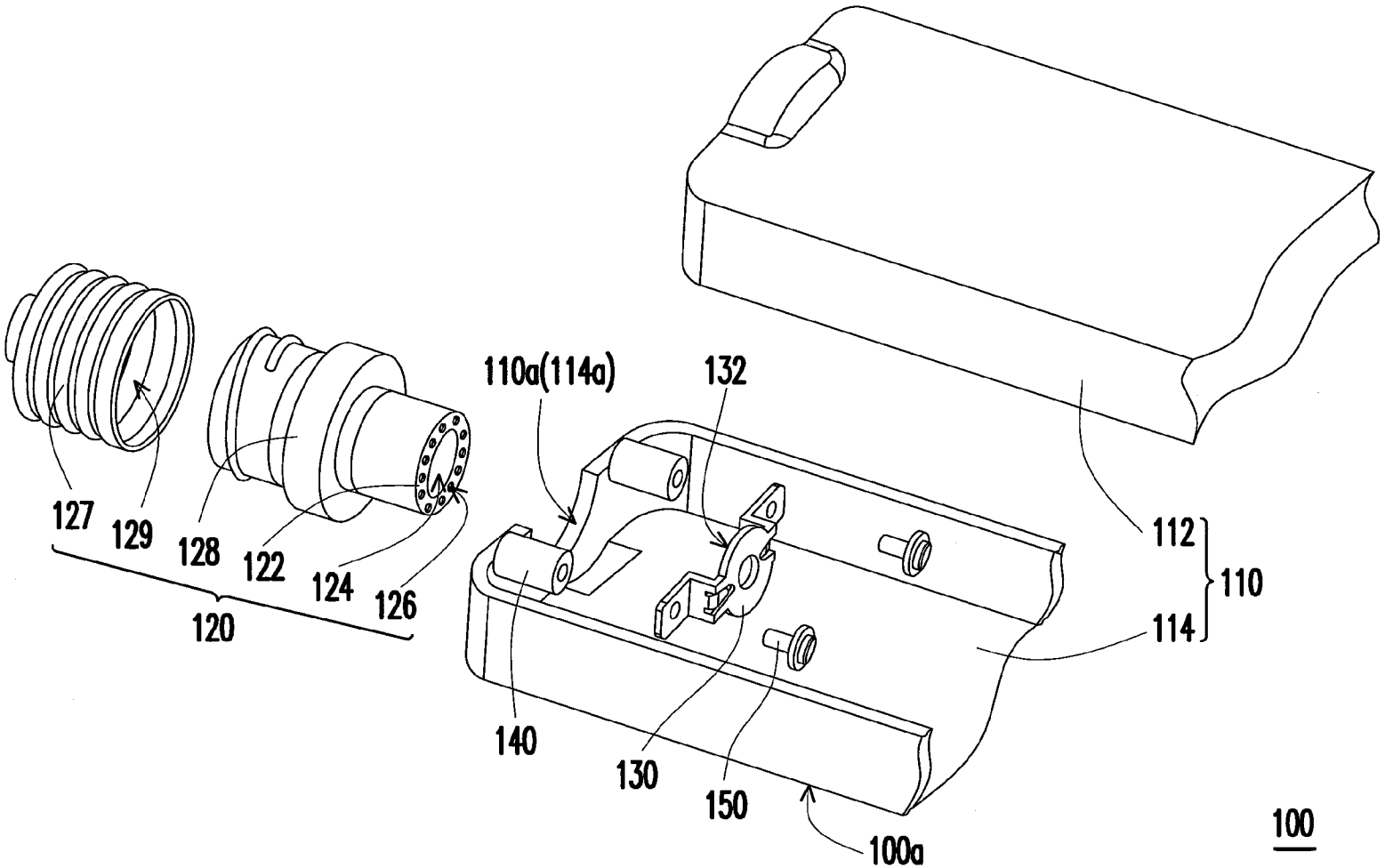
FIG. 1 is a schematic exploded view of a lamp according to an embodiment of the invention.
Figure 2:
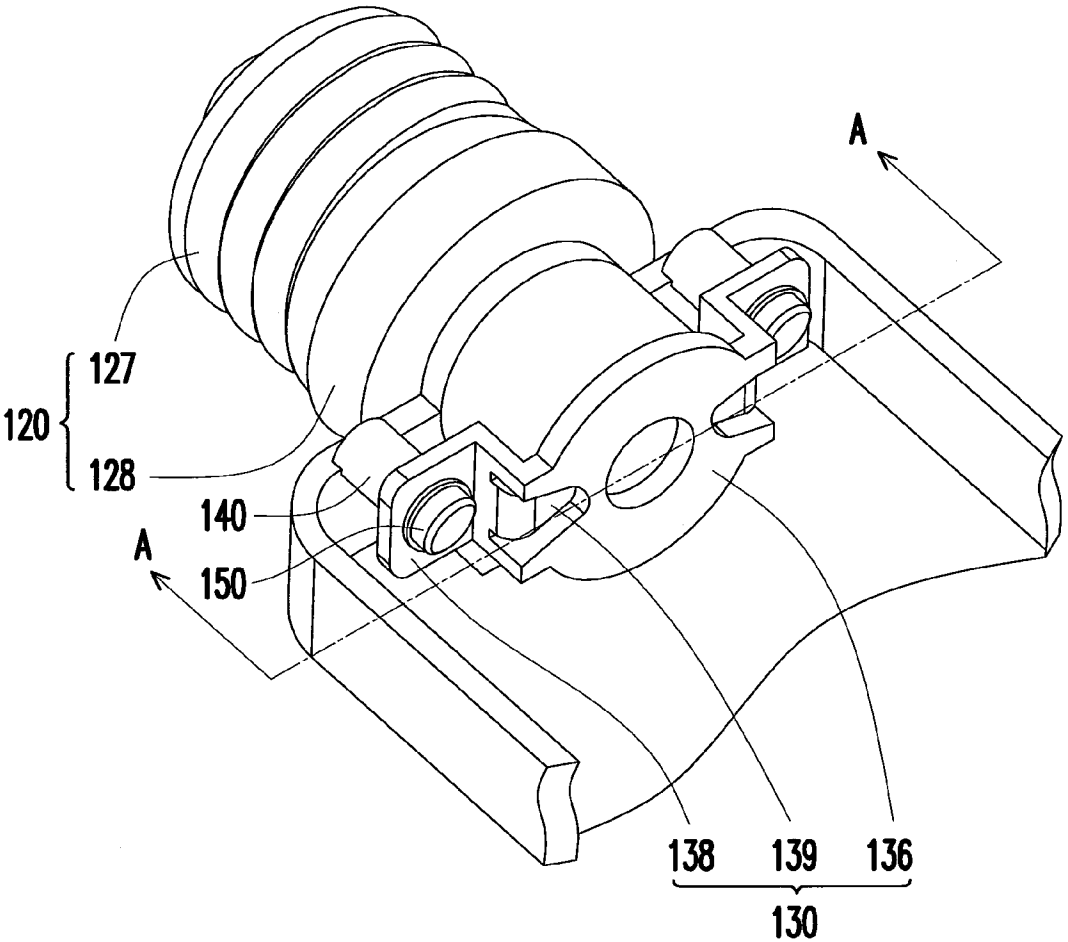
FIG. 2 is a partial assembled schematic view of the lamp of FIG. 1.
Figure 3:
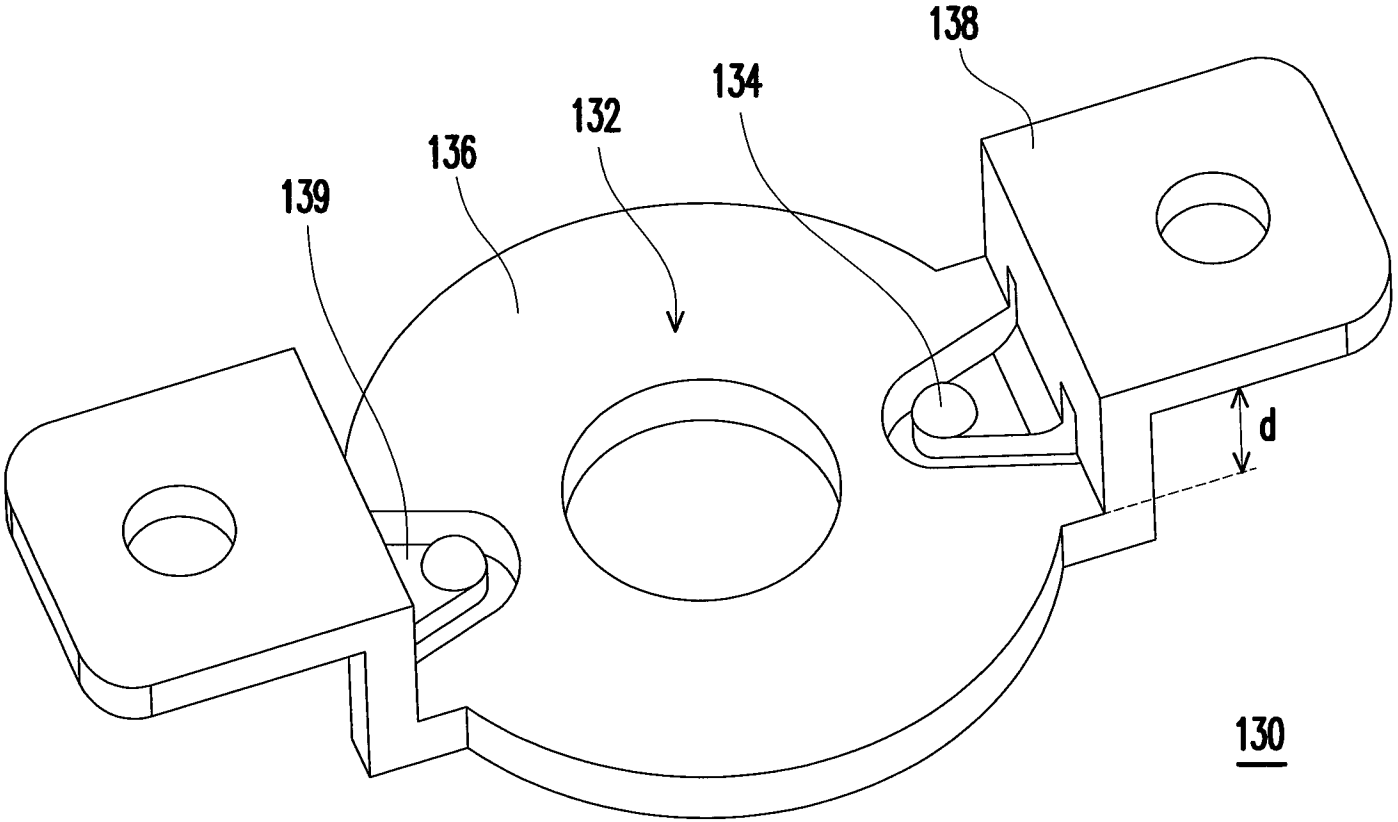
FIG. 3 is a three-dimensional view of a fixing elastomer of FIG. 1.

FIG. 1 is a schematic exploded view of a lamp according to an embodiment of the invention. FIG. 2 is a partial assembled schematic view of the lamp of FIG. 1. FIG. 3 is a three-dimensional view of a fixing elastomer of FIG. 1. Referring to FIG. 1, FIG. 2, and FIG. 3, the lamp 100 of the embodiment includes a case assembly 110, a lamp bottom 120, and a fixing elastomer 130. The case assembly 110 includes a first opening 110*a* (referenced in FIG. 5), and the lamp bottom 120 inserts into the first opening 110*a* to assemble with the case assembly 110. The lamp bottom 120 includes a first surface 122, a second opening 124, and a plurality of first positioning structures 126. The second opening 124 passes through the first surface 122, and the first positioning structures 126 are located on the first surface 122, and surround the second opening 124. The fixing elastomer 130 is disposed in the case assembly 110, and has a second surface 132 and a pair of second positioning structures 134. The second positioning structures 134 are disposed on the second surface 132, and lock with two of the first positioning structures 126, so as to fix an angle of the case assembly 110 relative to the lamp bottom 120.

In detail, the lamp bottom 120 includes a main body 127 and a base 128. The main body 127 includes a concave 129, and the base 128 is detachably assembled to the concave 129 of the main body 127. The base 128 is suitable to be inserted into the first opening 110*a*, wherein the first surface 122, the second opening 124, and the first positioning structures 126 are disposed in the base 128.

In addition, the fixing elastomer 130 includes a circular body portion 136 and a pair of locking portions 138. The locking portions 138 are bent and extended from the opposite sides of the circular body portion 136. A displacement d is between the locking portions 138 and the circular body portion 136, and the second positioning structures 134 are disposed on the circular body portion 136. In addition, the lamp 100 of the embodiment further includes a pair of protrusions 140 disposed in the case assembly 110. The protrusions 140 are located on the opposite sides of the first opening 110*a*, and the locking portions 138 are disposed on and around the protrusions 140. In addition, in order to fix the fixing elastomer 130 onto the protrusions 140, the lamp 100 further includes a pair of locking elements 150. The locking elements 150 pass through the locking portions 138 and lock into the protrusions 140, so that the fixing elastomer 130 is fixed relative to the case assembly 110. In other embodiments that are not shown, the locking elements 150 can be omitted, and the locking portions 138 of the fixing elastomer 130 can be directly disposed and tightly matched with the protrusions 140. Or, the protrusions 140 can be omitted, and the locking elements 150 directly pass through the locking portions 138 of the fixing elastomer 130 to fix to the case assembly 110.

Figure 5:
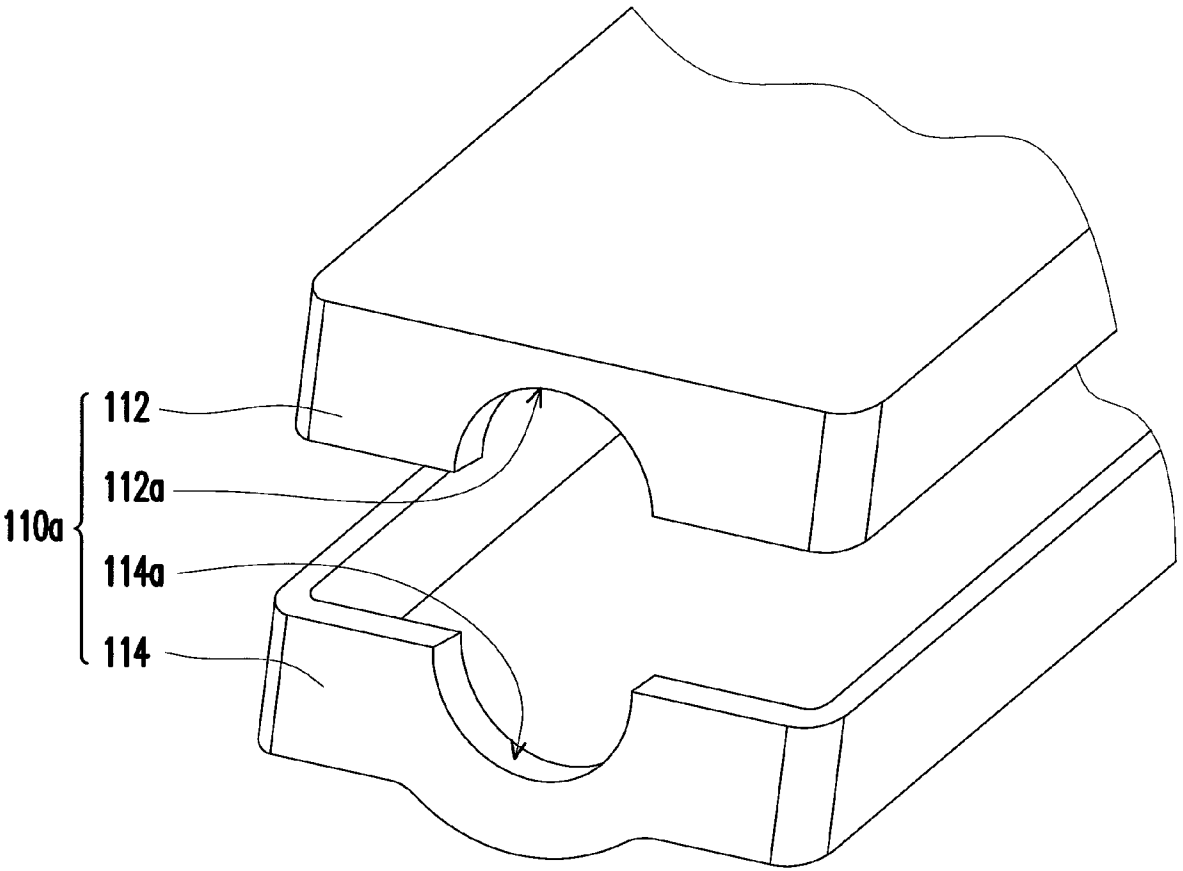
FIG. 5 is a schematic exploded view of a first casing and a second casing of the lamp in FIG. 1.

In addition, the case assembly 110 includes a first casing 112 and a second casing 114 that is detachably assembled to the first casing 112. The protrusions 140 of the embodiment are disposed on the second casing 114, but can also be disposed on the first casing 112 according to design requirement. Furthermore, the first casing 112 includes a first concave opening 112*a*, and the second casing 114 includes a second concave opening 114*a*. The second concave opening 114*a* and the first concave opening 112*a* together form the first opening 110*a*, as shown in FIG. 5.

Referring to FIG. 1, FIG. 2, and FIG. 3, the fixing elastomer 130 further includes a pair of elastic arms 139 between the circular body portion 136 and the locking portions 138. The second positioning structures 134 are disposed on the elastic arms 139. In addition, the elastic arms 139 are formed from hollowing out a connection area between the circular body portion 136 and the locking portions 138. The embodiment specifically causes the first positioning structures 126 to be concaves, and the second positioning structures 134 to be protrusions. This design can prevent damage that is caused if the first positioning structures 126 are protrusions and the second positioning structures 134 are concaves. In that design, when the case assembly 110 rotates relative to the lamp bottom 120, the protrusions will continue to rub and damage the fixing elastomer 130, which may further cause the first positioning structures 126 and the second positioning structures 134 to be unable to lock together, and the relative position between the case assembly 110 and the lamp bottom 120 will be unable to be fixed.

Figure 4:
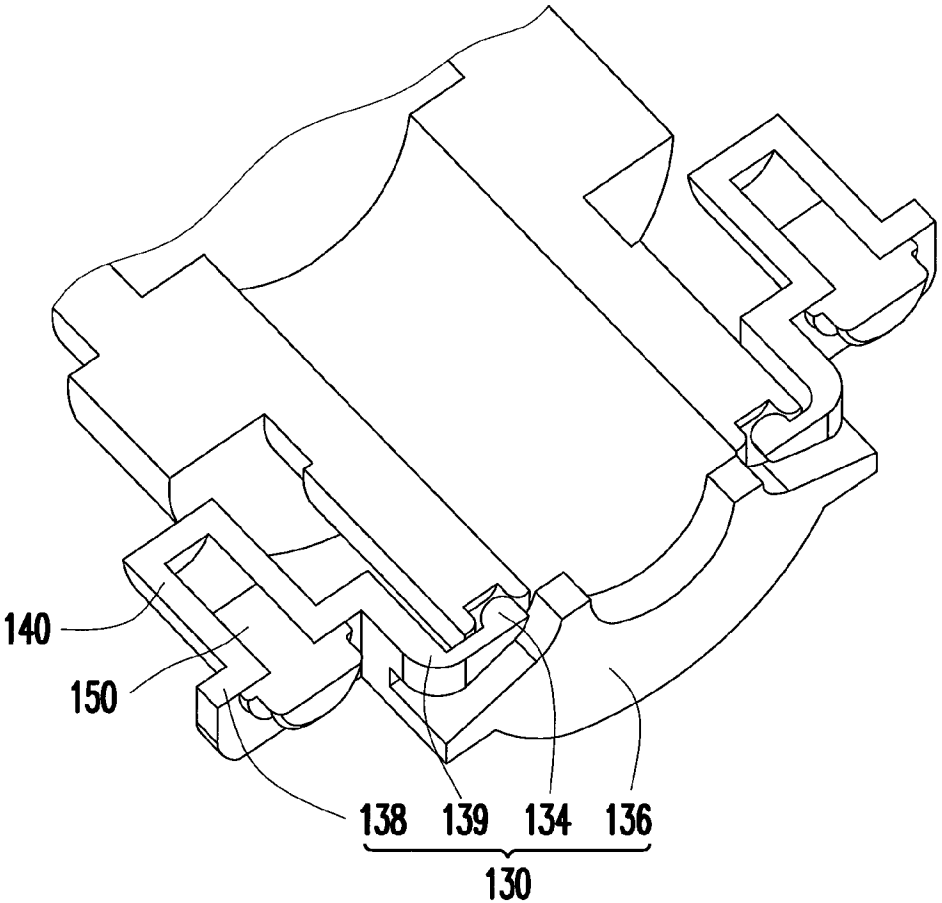
FIG. 4 is a schematic cross-sectional view along line A-A in FIG. 2.

FIG. 4 is a schematic cross-sectional view along line A-A' in FIG. 2. Referring to FIG. 1, FIG. 3, and FIG. 4, when the user wants to adjust a light emitting surface 100*a* of the lamp 100 relative to an angle of the user, the user moves the case assembly 110, so that the case assembly 110 rotates relative to the lamp bottom 120 with the lamp bottom 120 as the central axis. With the rotation of the case assembly 110 relative to the lamp bottom 120, the second positioning structures 134 that are protrusions leave the originally locked corresponding first positioning structures 126 that are concaves, and lock into the next first positioning structures 126 that are concaves, until the light emitting surface 100*a* relative to the angle of the user is adjusted to the satisfaction of the user.

More particularly, since the second positioning structures 134 are disposed on the elastic arms 139, when the case assembly 110 rotates relative to the lamp bottom 120, the elastic arms 139 provide an elastic force causing the second positioning structures 134 to move along the concave and the outline of the first surface 122, until the second positioning structures 134 that are protrusions lock into the next first positioning structures 126 that are concaves along the rotation direction.

Through the mutual locking between the first positioning structures 126 and the second positioning structures 134, the relative position between the case assembly 110 and the lamp bottom 120 can be fixed. In addition, when the first positioning structures 126 and the second positioning structures 134 are locked together, a vibration is transmitted so that the user feels the locking motion. This allows the user to know how many first positioning structures 126 the rotation has passed. Herein the number of first positioning structures 126 can be adjusted, so that the user can calculate the rotated angle between the case assembly 110 and the lamp bottom 120 by knowing how many first positioning structures 126 the second positioning structures 134 have passed.

To sum up, in the lamp of the invention, since the case assembly is disposed on and around the lamp bottom, the effect of rotation between the lamp bottom and the case assembly is achieved. When the lamp bottom is rotated into a lamp body of the lamp, and the light emitting surface of the case assembly is not as the user expected, the user can rotate the case assembly relative to the lamp bottom, so as to adjust the angle of the light emitting surface of the case assembly relative to the user.

In addition, through the mutual locking between the first positioning structures and the second positioning structures, the relative position between the case assembly and the lamp bottom can be fixed. Furthermore, through the design of the elastic arms, when the first positioning structures and the second positioning structures lock, a locking feeling is generated so that the user knows how many first positioning structures have been passed. This way, the rotated angle between the case assembly and the lamp bottom can be calculated.

Though the invention has been disclosed above by the embodiments, they are not intended to limit the invention. It will be apparent to one of ordinary skill in the art that modifications and variations to the described embodiments may be made without departing from the spirit and scope of the invention. Therefore, the protecting range of the invention falls in the appended claims.

What is claimed is:

1. A lamp, comprising:

a case assembly, including a first opening;

a lamp bottom, inserted into the first opening so as to be assembled to the case assembly, wherein the lamp bottom includes a first surface, a second opening, and a plurality of first positioning structures, wherein the second opening passes through the first surface, and the first positioning structures are located on the first surface; and a fixing elastomer, assembled in the case assembly, and includes a second surface and a pair of second positioning structures, wherein the pair of second positioning structures are disposed on the second surface, and lock with two of the first positioning structures.

2. The lamp as claimed in claim 1, wherein the first positioning structures are concaves, and the second positioning structures are protrusions.

3. The lamp as claimed in claim 1, wherein the fixing elastomer includes a circular body portion and a pair of locking portions, and the pair of locking portions are bent and extended from opposite sides of the circular body portion, and a displacement is between the pair of locking portions and the circular body portion, wherein the second positioning structures are disposed on the circular body portion.

4. The lamp as claimed in claim 3, further comprising a pair of protrusions disposed in the case assembly, wherein the protrusions are located on opposite sides of the first opening, and the locking portions are disposed on and around the protrusions.

5. The lamp as claimed in claim 4, further comprising a pair of locking elements, passing through the pair of locking portions and fixed to the case assembly.

6. The lamp as claimed in claim 3, further comprising a pair of locking elements, passing through the fixing elastomer and fixed to the case assembly.

7. The lamp as claimed in claim 3, wherein the fixing elastomer further includes a pair of elastic arms located between the circular body portion and the locking portions, and the second positioning structures are disposed on the elastic arms.

8. The lamp as claimed in claim 7, wherein the pair of elastic arms are formed from hollowing out a connection area between the circular body portion and the locking portions.

9. The lamp as claimed in claim 1, wherein the lamp bottom comprises:

a main body, including a concave; and a base, wherein the base is detachably assembled to the concave of the main body, and the base is suitable to be inserted into the first opening, wherein the first surface, the second opening, and the first positioning structures are disposed in the base.

10. The lamp as claimed in claim 1, wherein the case assembly comprises:

a first casing; and a second casing, wherein the second casing is detachably assembled to the first casing.

11. The lamp as claimed in claim 10, wherein the first casing includes a first concave opening, and the second casing includes a second concave opening, and the second concave opening and the first concave opening together form the first opening.

* * * * *